United States Patent [19]

Caranica

[11] Patent Number: 4,850,927

[45] Date of Patent: Jul. 25, 1989

[54] PLUSH INFANT TOY

[75] Inventor: Gloria Caranica, Orchard Park, N.Y.

[73] Assignee: Kiddie Products, Inc., Avon, Mass.

[21] Appl. No.: 169,408

[22] Filed: Mar. 17, 1988

Related U.S. Application Data

[63] Continuation-in-part of Ser. No. 142,220, Jan. 8, 1988.

[51] Int. Cl.[4] ..... A63H 3/02; A63H 5/00; A61J 17/00

[52] U.S. Cl. ..... 446/369; 446/409; 128/359

[58] Field of Search ..... 446/369, 409, 229, 269, 446/270, 370, 371, 372, 385, 404, 419; 128/359; 273/58 F, 58 K

[56] References Cited

U.S. PATENT DOCUMENTS

| | | | |
|---|---|---|---|
| 966,127 | 8/1910 | Samstag | 446/321 |
| 1,099,208 | 6/1914 | Schiffer | 446/321 |
| 1,258,651 | 3/1918 | Broderick | 446/409 |
| 2,112,316 | 3/1938 | Turner | 446/419 X |
| 2,195,127 | 3/1940 | Brucker | 446/321 |
| 2,703,087 | 3/1955 | Newmark | 128/359 |
| 2,766,757 | 10/1956 | Zelony | 128/359 |
| 3,633,587 | 1/1972 | Hunt | 273/58 K |
| 3,811,220 | 5/1974 | Glass et al. | 446/321 |
| 4,107,873 | 8/1978 | Bauer | 446/321 |
| 4,120,100 | 10/1978 | Dugan | 434/403 |
| 4,192,903 | 3/1980 | Tremblay | 428/8 |
| 4,206,568 | 6/1980 | Garner | 446/371 |
| 4,249,333 | 2/1981 | Chase et al. | 128/359 X |
| 4,336,656 | 6/1982 | Moreau | 446/321 |
| 4,413,442 | 1/1983 | McSweeney | 446/73 |
| 4,563,159 | 1/1986 | Hills et al. | 446/74 |
| 4,596,726 | 6/1986 | Wrzalinski | 428/11 |
| 4,614,505 | 9/1986 | Schneider et al. | 446/372 |
| 4,655,723 | 4/1987 | Marason, Jr. et al. | 446/489 X |
| 4,695,264 | 9/1987 | McLeod, Jr. | 446/321 |

FOREIGN PATENT DOCUMENTS

| | | | |
|---|---|---|---|
| 1306039 | 2/1973 | United Kingdom | 446/489 |

OTHER PUBLICATIONS

"Space Rings", Creative Playthings, 10/68, p. 28.

*Primary Examiner*—Robert A. Hafer
*Assistant Examiner*—D. Neal Muir

[57] ABSTRACT

A plush toy for an infant, e.g., a ball or the like, has a plurality of rings each having a pair of plush arms of a size to be grasped by an infant. The rings include a first center ring having a center portion with the pair of arms bearing a display of a face on a first surface, and an outer ring defining an open center portion, whereby the display may be glimpsed between the arms of the rings. In a preferred embodiment, the first center ring bears a display of a face on first and second opposite surfaces, and the rings include a first outer ring disposed adjacent the first surface of the center ring and a second outer ring adjacent the second surface of the center ring. A method and toy made by the method are also described.

11 Claims, 3 Drawing Sheets

PLUSH INFANT TOY

This application is a continuation-in-part application of U.S. Ser. No. 142,220, filed Jan. 8, 1988, for the design of an Infant Toy.

The invention relates to an infant toy in the form of a stuffed plush ball, or the like.

SUMMARY OF THE INVENTION

According to one aspect of the invention, a plush toy for an infant in the form of a ball or the like comprises a plurality of rings each having a pair of plush arms of a size to be grasped by an infant, the rings comprising a first center ring further having a center portion within the pair of arms bearing a display of a face on a first surface, and an outer ring defining an open center portion, whereby the display may be glimpsed between the arms of the rings.

In the preferred embodiment, the first center ring bears a display of a face on first and second opposite surfaces, and the rings further comprise a first outer ring disposed adjacent the first surface of the center ring and a second outer ring adjacent the second surface of the center ring. Also, the toy may further comprise a rattle.

According to another aspect of the invention, a plush toy for an infant having the form of a ball or the like is formed by the method of providing a plurality of rings each having a pair of plush arms of a size to be grasped by an infant, the rings comprising a first center ring further having a center portion within the pairs of arms defining first and second surfaces, and two outer rings defining open center portions within the pairs of arms, assembling the center ring with a first outer ring disposed adjacent the first surface of the center ring, and a second outer ring disposed adjacent the second surface of the center ring, and joining the outer rings to the center ring.

In preferred embodiments of this aspect of the invention, the method further comprises the step of providing a display of a face upon at least one surface of the center ring, and arranging the arms of the adjacent outer ring whereby the display may be glimpsed between the arms, preferably displays are provided on first and second opposite surfaces of the center ring. The method further comprises disposing a rattle within the center ring.

A plush infant toy formed by this method is also described.

There is thus provided an infant toy in the shape of a ball or the like formed by a plurality of rings having plush arms of a size to be grasped by an infant. The center ring has a cartoon face that may be glimpsed between the arms of outer rings. The arms are made of stuffed fabric pieces of different bright colors, patterns and textures, and the ball contains a rattle, to attract and keep the interest of an infant.

Other features and advantages of the invention will be understood from the following description of a presently preferred embodiment, and from the claims.

PREFERRED EMBODIMENT

We first briefly describe the drawings.

Figure 1:
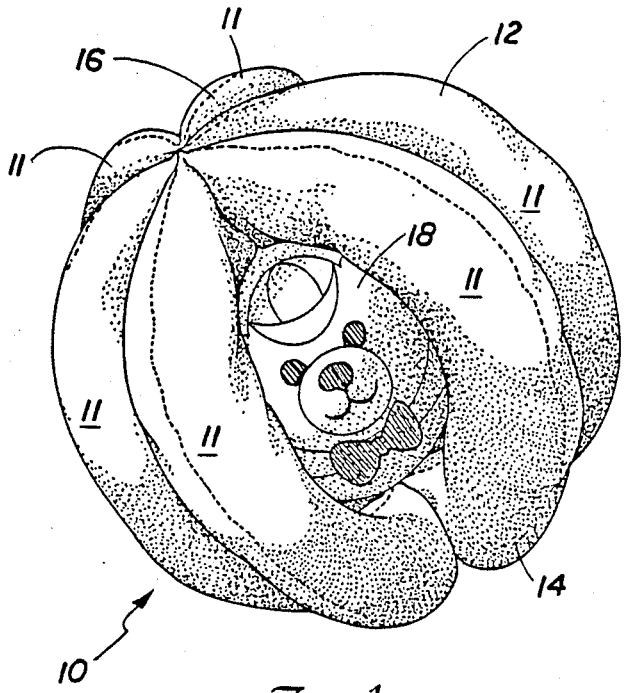
FIG. 1 is a perspective view of the toy of the invention.
Figure 6:
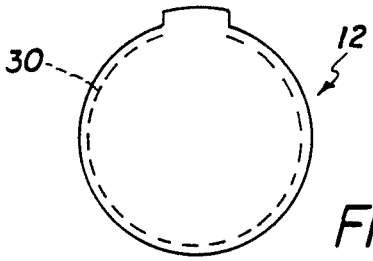
Figure 6A:
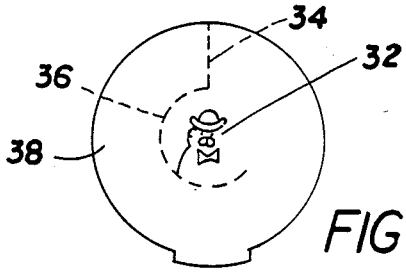
Figure 6B:
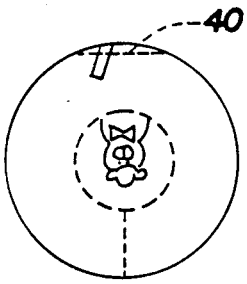
Figure 7:
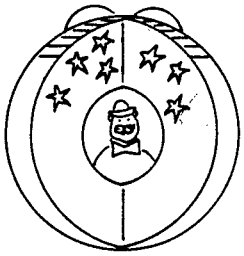
Figure 7:
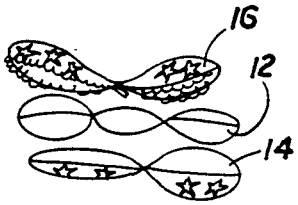

FIG. 5, 5*a*, 5*b* and 5*c* are somewhat diagrammatic views of the sequence of forming the outer rings of the toy of FIG. 1;

FIGS. 6, 6*a* and 6*b* are similar views of the sequence of forming the center ring of the toy; and FIG. 7 is a similar view of the step of assembling the rings into the toy of the invention.

Referring to the figures, the plush infant toy 10 of the invention has the shape of a ball formed by a plurality of soft arms 11 provided by the assembly of a center ring 12, and a pair of outer rings 14, 16 attached to the center ring, e.g. by stitching on a vertical axis A. The inner portion of the center ring, on each opposite surface, displays, e.g., a cartoon bear face 18, and the outer rings 14, 16 are open at their centers to allow an infant to glimpse the cartoon face between the arms of the rings. The peripheries of each of the rings is plush, e.g., fiber filled, and of a size to allow a small infant to grasp the toy by any of the arms. The center ring 12 contains a rattle, or other noisemaker, actuated as an infant manipulates the toy. The ring halves are made of fabric pieces, assembled in contrasting colors, patterns and fabric textures to attract and keep the interest of an infant.

Figure 5:
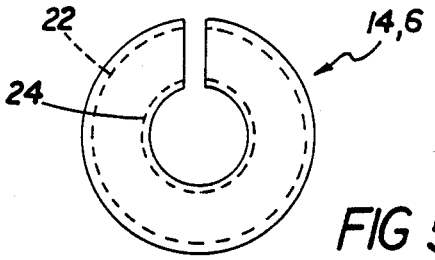
Figure 5A:
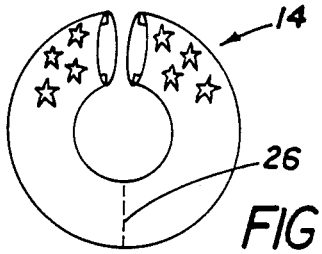
Figure 5B:
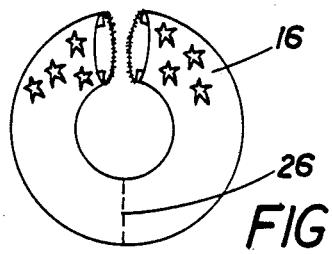
Figure 5C:
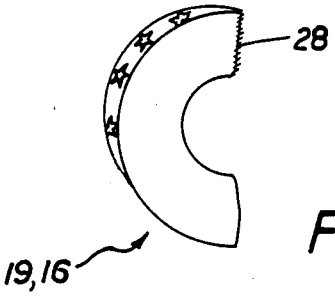

Referring also to FIG. 5 et seq., the outer rings are formed by stitching 22, 24 together two pieces of fabric in ring shape (FIG. 5). (For example, first outer ring 14 is a piece of polyester/cotton blend (65/35) fabric with a star pattern, stitched to a polyester terry cloth piece bonded to paper to control stretch, the second outer ring 16 is a star pattern piece of different color stitched to a 100% nylon piece). The stitched pieces are turned inside out (FIGS. 5*a* and 5*b*), and stitched at 26. The ring halves are stuffed with polyester fiber fill and the opening sewn together at 28 to form the outer rings.

To form the center ring 12, two decorated pieces of 100% polyester tricot knit fabric, bonded to $\frac{1}{8}$ inch uretrane foam and backed with 15 denier knit tricot, are sewn together by stitching about line 30 (FIG. 6). The stitched assembly is turned inside out (FIG. 6*a*) to display face patterns 18 provided on each outer surface, and trapping a rattle 32, e.g., a high impact polystyrene case containing brass pellets, between the fabric pieces of the ring. The fabric pieces are stitched together axial at 34, and on line 36 about the rattle. The peripheral ring portion 38 is stuffed with polyester fiber fill and the ring is stitched closed 40 at (FIG. 6*b*).

Figure 2:
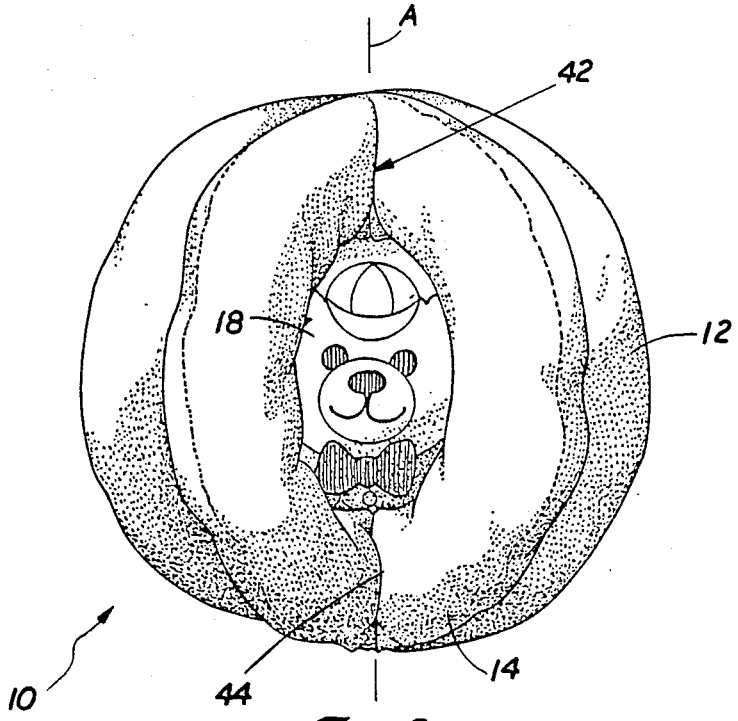
FIG. 2 is a face view of the toy of FIG. 1.
Figure 3:
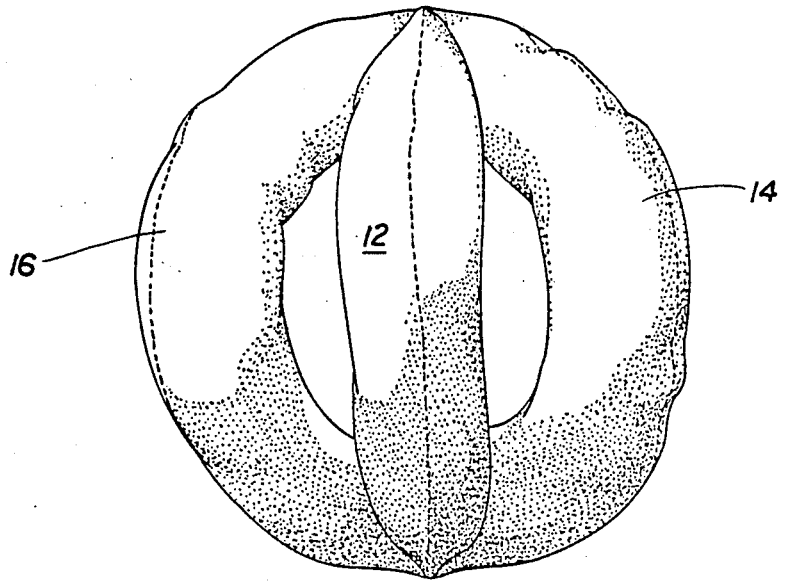
FIG. 3 is a side view of the toy of FIG. 1.
Figure 4:
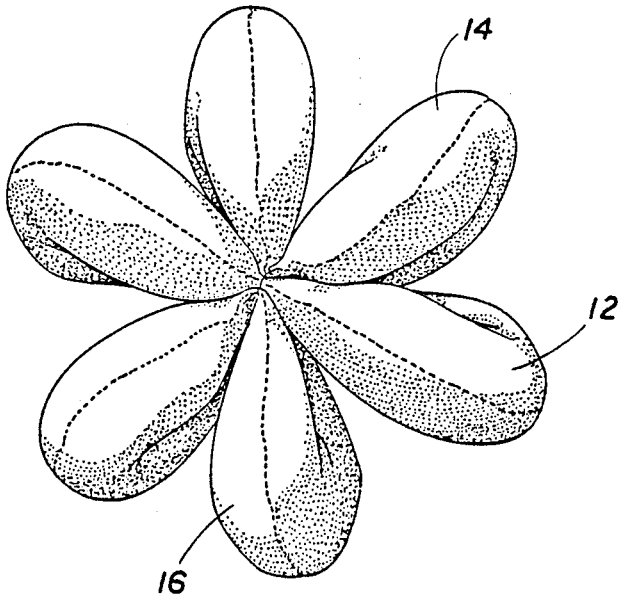
FIG. 4 is a plan view of the toy of FIG. 1.

The rings 12, 14, 16 are then stacked (FIG. 7) and stitched at 42 and 44, along axis A (FIG. 2), to create the toy 10 of the invention (also seen in FIG. 7).

Other embodiments of the invention are within the following claims.

What is claimed is:

1. A plush toy for an infant in the form of a generally spherical ball, comprising a plurality of stuffed rings of common diameter, each said ring comprising a pair of plush arms of a size to be grasped by an infant, said rings comprising:

a center ring further having a center portion within said pair of arms bearing a display of a face on a first surface, said first center ring lying in a center plane, and at least one outer ring defining an open center portion, a first arm of each said outer ring lying in a first plane and a second arm of each said outer ring lying in a second plane, said first plane and said second plane each disposed to intersect with said center plane at oblique angles, whereby the arms in combination have the form of a ball and said display may be glimpsed between the arms of said outer rings.

2. The plush toy of claim 1 wherein said first center ring bears a display of a face on first and second opposite surfaces, and said rings comprise a first said outer ring disposed adjacent said first surface of said center ring and a second said outer ring adjacent said second surface of said center ring.

3. The plush infant toy of claim 1 or 2 further comprising a rattle.

4. A plush toy for an infant having the form of a generally spherical ball, formed by the method of:

providing a plurality of stuffed rings of common diameter each having a pair of plush arms of a size to be grasped by an infant, said rings comprising a center ring further having a center portion within said pairs of arms defining first and second surfaces, said first center ring lying in a center plane, and two outer rings defining open center portions within said pairs of arms, assembling said center ring with a first said outer ring disposed adjacent the first surface of said center ring, and a second said outer ring disposed adjacent the second surface of said center ring, and joining said outer rings to said center ring with first arms of each said outer ring lying in first planes and second arms of each siad outer ring lying in second planes, said first planes and said second planes each disposed to intersect with said center plane at oblique angles.

5. The plush toy of claim 4 formed by a method further comprising the step of providing a display of a face upon at least one surface of said center ring, and arranging the arms of the adjacent outer ring whereby said display may be glimpsed between said arms.

6. The plush toy of claim 5 formed by a method further comprising the step of providing displays on the first and second opposite surfaces of said center ring.

7. The plush toy of claim 4 formed by a method further comprising a step of disposing a rattle within said center ring.

8. The method for forming a plush toy for an infant having the form of a generally spherical ball, comprising the steps of:

providing a plurality of stuffed rings of common diameter each having a pair of plush arms of a size to be grasped by an infant, said rings comprising a center ring further having a center portion within said pairs of arms defining first and second surfaces, said first center ring lying in a center plane, and two outer rings defining open center portions within said pairs of arms, assembling said center ring with a first said outer ring disposed adjacent the first surface of said center ring, and a second outer ring disposed adjacent the second surface of said center ring, and joining said outer rings to said center ring with first arms of each said outer ring lying in first planes and second arms of each said outer ring lying in second planes, said first planes and said second planes each disposed to intersect with said center plane at oblique angles.

9. The method of claim 8 further comprising the step of providing a display of a face upon at least one surface of said center ring, and arranging the arms of the adjacent outer ring whereby said display may be glimpsed between said arms.

10. The method of claim 9 further comprising the step of providing displays on first and second opposite surfaces of said center ring.

11. The method of claim 8 further comprising a step of disposing a rattle within said center ring.

* * * * *

UNITED STATES PATENT AND TRADEMARK OFFICE

CERTIFICATE OF CORRECTION

PATENT NO. : 4,850,927

DATED : July 25, 1989

INVENTOR(S) : Gloria Caranica

It is certified that error appears in the above-identified patent and that said Letters Patent is hereby corrected as shown below:

On title page, item [56],

In the Cited References:

Change the patent number of the Moreau reference from "4,336,656" to --4,336,665--.

Change the date of the McSweeney reference Pat. No. 4,413,442 from "1/1983" to --11/1983--.

Column 3, line 30, claim 4, delete "siad" and insert therefore --said--.

Signed and Sealed this

Thirtieth Day of March, 1993

*Attest:*

STEPHEN G. KUNIN

*Attesting Officer*

*Acting Commissioner of Patents and Trademarks*